US012252960B2

(12) United States Patent
Poiate Junior

(10) Patent No.: US 12,252,960 B2
(45) Date of Patent: Mar. 18, 2025

(54) OIL RECOVERY METHOD INTEGRATED WITH THE CAPTURE, UTILIZATION AND STORAGE OF CO2 THROUGH A CAVERN IN SALINE ROCK

(71) Applicant: Petróleo Brasileiro S.A.—Petrobras, Rio de Janeiro (BR)

(72) Inventor: Edgard Poiate Junior, Rio de Janeiro (BR)

(73) Assignee: Petróleo Brasileiro S.A.—Petrobras, Rio de Janeiro (BR)

( * ) Notice: Subject to any disclaimer, the term of this patent is extended or adjusted under 35 U.S.C. 154(b) by 0 days.

(21) Appl. No.: 18/086,322

(22) Filed: Dec. 21, 2022

(65) Prior Publication Data

US 2023/0203918 A1 Jun. 29, 2023

(30) Foreign Application Priority Data

Dec. 23, 2021 (BR) ..... 10 2021 026298 2

(51) Int. Cl.

| | |
|---|---|
| ***E21B 41/00*** | (2006.01) |
| ***E21B 43/28*** | (2006.01) |
| ***E21B 49/00*** | (2006.01) |
| *E21B 43/16* | (2006.01) |

(52) U.S. Cl.

CPC ..... *E21B 41/0064* (2013.01); *E21B 43/28* (2013.01); *E21B 49/00* (2013.01); *E21B 43/166* (2013.01)

(58) Field of Classification Search

CPC ..... E21B 41/0064; E21B 43/28; E21B 49/00; E21B 43/166

See application file for complete search history.

(56) References Cited

U.S. PATENT DOCUMENTS

| | | | | |
|---|---|---|---|---|
| 2,623,596 | A | 12/1952 | Whorton et al. | |
| 3,525,395 | A | 8/1970 | Chew | |
| 2011/0206459 | A1* | 8/2011 | Tunget | E21B 43/006 405/53 |
| 2013/0064604 | A1* | 3/2013 | Han | E21B 33/10 405/53 |
| 2014/0354031 | A1* | 12/2014 | Haugen | E21B 43/28 299/4 |
| 2016/0053594 | A1* | 2/2016 | Nazarian | C09K 8/58 166/305.1 |
| 2019/0284918 | A1* | 9/2019 | Tritt | C02F 1/041 |

(Continued)

OTHER PUBLICATIONS

United States Department of Energy Carsbad Field Office, United States Environmental Protection Agency, Apr. 28, 2006, 2 pages.

(Continued)

*Primary Examiner* — Silvana C Runyan

(74) *Attorney, Agent, or Firm* — Mintz, Levin, Cohn, Ferris, Glovsky, and Popeo, P.C.

(57) ABSTRACT

The present invention finds its field of application among the advanced oil recovery methods, which must occur simultaneously and integrated with the capture, utilization, and storage of CO2 through a cavern built in offshore saline rock. More particularly the invention refers to offshore oil wells where there is an evaporitic rock layer next to it and, suitable for constructing a cavern in the saline rock, for its use as a CO2 and brine control volume in the water-gas alternating injection process in the reservoir.

17 Claims, 6 Drawing Sheets

(56) References Cited

U.S. PATENT DOCUMENTS

2019/0368348 A1* 12/2019 Tiwari ..... E21B 41/0007
2020/0115283 A1* 4/2020 Kvassnes ..... C04B 40/0039

OTHER PUBLICATIONS

Beltrao et al. (2009) "Challenges and New Technologies for the Development of the Pre-Salt Cluster, Santos Basin, Brazil", Offshore Technology Conference, 11 pages.
Crotogino et al. (Apr. 2001) "Huntorf CAES: More than 20 Years of Successful Operation", Solution Mining Research Institute, 7 pages.
Grigg et al. (2008) "Injectivity Changes and CO2 Retention for EOR and Sequestration Projects", SPE International (SPE 110760), 13 pages.
Janeiro, Der. (2020) "Estudo sobre o aproveitamento do gas natural do Pro-sal,", http://www.anp.gov.br/arquivos/estudos/aproveitamento-gn-presal.
Lima et al. (2020) "Assessment of Continuous and Alternating CO2 Injection Under Brazilian-pre-salt-like Conditions", Journal of Petroleum Exploration and Production Technology, 10:2947-2956.
Lord et al. (Sep. 23, 2014) "Geologic Storage of Hydrogen: Scaling Up to Meet City Transportation Demands", International Journal of Hydrogen Energy, 39:15570-15582.
Munson et al. (1989) "Approach to First Principles Model Prediction Of Measured WIPP in Situ Room Closure in Salt", Tunneling and Underground Space Technology, 16 pages.
Poiate, Edgard Jr. (Dec. 20, 2012) "Mecanica das Rochas e Mecanica Computacional para Projeto de Pocos de Petroleo em Zonas de Sal.", Pontificia Universidade Catalica do Rio de Janeiro, 40 pages.
Pizarro et al. (Apr. 16, 2012) "Challenges in Implementing an EOR Project in the Pre-Salt Province in Deep Offshore Brasil", SPE International (SPE-155665), 13 pages.
Qadir et al. (Mar. 15, 2012) "Comparative Study of FAWAG and SWAG as an Effective EOR Technique for a Malaysian Field", Research Journal of Applied Sciences, Engineering and Technology, 4(6):645-648.
Schaefer et al. (2017) "Technical-Economic Evaluation of Continuous CO2 Reinjection, Continuous Water Injection and Water Alternating Gas (Wag) Injection in Reservoirs Containing CO2", Cilamce, 16 pages.
Schainker, Robert B. (2011) "Advanced Compressed Air Energy Storage (CAES) Demonstration Projects", Electronic Power Research Institute, 8 pages.
Touma et al. (Oct. 2019) "Innovative Gas Treatment Solutions for Offshore Systems", OTC-29913-MS, 9 pages.
Veil et al. (1998) "Disposal of NORM-Contaminated Oil Field Wastes in Salt Caverns", Solution Mining Research Institute Spring, 17 pages.
Venkataramani et al. (Sep. 2016) "A Review on Compressed Air Energy Storage—A Pathway for Smart Grid And Polygeneration", Renewable and Sustainable Energy Reviews, 62:895-907.
Xie et al. (2009) "Research Advance of CO2 Storage in Rock Salt Caverns", Yantu Lixue/Rock and Soil Mechanics, 3324-3330.
Evans et al. (2009) "Underground Gas Storage: Worldwide Experiences and Future Development in the UK and Europe", The Geological Society, 313:93-128.
Lord, Anna S. (2009) "Overview of Geologic Storage of Natural Gas with an Emphasis on Assessing the Feasibility of Storing Hydrogen", Sandia National Laboratories, 28 pages.

* cited by examiner

OIL RECOVERY METHOD INTEGRATED WITH THE CAPTURE, UTILIZATION AND STORAGE OF CO2 THROUGH A CAVERN IN SALINE ROCK

CROSS-REFERENCE TO RELATED APPLICATION

This application claims priority to Brazilian Application No. BR 10 2021 026298 2, filed on Dec. 23, 2021, and entitled "OIL RECOVERY METHOD INTEGRATED WITH THE CAPTURE, UTILIZATION AND STORAGE OF CO2 THROUGH A CAVERN IN SALINE ROCK," the disclosure of which is incorporated herein by reference in its entirety.

FIELD OF INVENTION

The present invention finds its field of application among the advanced oil recovery methods, which must occur simultaneously and integrated with the Capture, Utilization, and storage of CO2 through a cavern built in the saline rock. More particularly the invention refers to offshore oil wells where there is an evaporitic rock layer next to it and, suitable for constructing a cavern in the saline rock, for its use as a CO2 and brine control volume in the water-gas alternating injection process in the reservoir.

DESCRIPTION OF THE STATE OF THE ART

Advanced Oil Recovery.

A hydrocarbon reservoir has a pressure associated with the fluids stored in it (primary energy) that can lead to the oil/gas flow from the rock formation to the surface, a scenario known as production by natural elevation in an upwelling well. Since the well flow capacity is given by the productivity index (PI), which depends on the relationship between the oil flow under surface conditions and the differential static pressure of the reservoir and the flow pressure at the bottom of the well.

However, over the course of production, depending on the intrinsic characteristics of the reservoir rock and hydrocarbon, the fluid pressure, which tends to drop and with it the PI, is not suitable to overcome the resistance (load loss) generated in the flow in the porous medium and in the production column to produce a viable volume of oil/gas in a technical (for process operation) and economic way (THOMAS, J. E. et al. Fundamentos de engenharia de petróleo. Rio de Janeiro: ed. Interciência, 2004).

Thus, it is necessary to apply artificial methods of elevation and/or drainage as an important alternative to mitigate the problems that occur with the decline in the reservoir pressure, over the time of production. And even the increase of the reserve recovery factor, to maintain or increase the production flow rate thereof to meet the technical and economic requirements throughout the productive life of the well.

The methods that make the energy supply in the reservoir and make it possible to increase the recovery factor are called methods of secondary and tertiary recovery or advanced recovery, that is, Enhanced Oi/Recovery (EOR).

U.S. Pat. No. 2,623,596 discloses an EOR method, through the injection of CO2 into the oil reservoir. And U.S. Pat. No. 3,525,395 discloses the EOR method in which water must be injected alternately with a gas in the reservoir, that is, Alternate Gas and Water but, which is recently called Water Alternating Gas (WAG) injection, in which the gas used in the injection can be hydrocarbon from the reservoir or even CO2.

The WAG method has advantages over the injection method of just gas or just water, in highly heterogeneous reservoirs, in terms of the efficiency of the scan volume in the reservoir, i.e. in the production.

This happens because the WAG injection delays the preferential paths of the gas, that is, fingering, through the bank injection of more viscous fluids that would retain the gas inside the reservoir for a longer time. Thus, the gas having more time in contact with the oil in the subsurface (in the reservoir) would be able to interact and incorporate the oil more effectively, reducing the oil viscosity, improving its mobility in the reservoir (GREEN, D. W. and WILLHITE G. P., 1998. Enhanced Oil Recovery, SPE Textbook Series, Volume 6. Society of Petroleum Engineers, Richardson, Texas).

WAG injection combines two predecessor methods (water injection or gas injection) and aims to improve the scan efficiency of the reservoir during the gas injection. Generally, the injected gas is the gas itself (hydrocarbon) coming from the reservoir, so the gas is reinjected into the reservoir to improve recovery efficiency and maintain reservoir pressure.

In the WAG method, the injection cycles are composed either of a gas bank or of a water bank. The injected gas has the function of mixing with the pre-existing reservoir fluid, thereby reducing its viscosity, decreasing its density, reducing the interfacial tension 15 oil/water and increasing its mobility in the porous medium (microscopic effect). And, the water bank, injected next, has the function of pushing (macroscopic effect) the mixed oil bank formed by the gas bank, which would not have been produced under normal conditions, thus increasing the reservoir recovery factor.

In addition, the WAG method makes it possible to delay the premature emergence of the injected gas, that is, early breakthrough, and control the increase in the Gas-Oil Ratio (RGO—"Razão Gás-Óleo") in the producing wells, otherwise it could lead to a reduction in oil production due to the limitations in the gas processing capacity in the Stationary Production Unit (SPU).

In a reservoir with the presence of CO2 it could be used in the WAG process instead of reinjecting the gas (hydrocarbon) produced (QADIR S., Comparative study of FAWAG and SWAG as an effective EOR technique for a Malaysian field, 2012). As well as the CO2 generated in the processes of a production unit (exhaust gases), thus reducing the effect of greenhouse gases released into the atmosphere.

In Brazil, the EOR-WAG process with CO2-rich stream has been used in the pre-salt fields (BELTRÃO, R. L. C.; SOMBRA, C. L.; LAGE, A. e. V. M.; FAGUNDES NETTO, J. R., HENRIQUES, e. e. D. Challenges and new technologies for the development of the pre-salt cluster, Santos Basin, Brazil. In: 2009 OFFSHORE TECHNOLOGY CONFERENCE, 2009; PIZARRO J. O. S., BRANCO, C. C. M. Challenges in Implementing an EOR Project in the Pre-Salt Province in Deep Offshore Brasil. In: SPE EOR Conference at Oil and Gas West Asia, Muscat, Oman, 2012), the separation and treatment of CO2 for reinjection being carried out using technologies to increase the treatment efficiency of the gas produced in the Brazilian pre-salt, such as, for example, through the development of new technologies in the membranes area, in order to increase the selectivity for CO2, in English, Carbon Molecular Sieves (CMS) (TOUMA et al. *Innovative Gas Treatment Solutions for Offshore Systems—Petrobras, OTC-29913-MS, OTC Brasil*, October 2019; ANP, Estudo sobre o aproveitamento do gas natural do Pré-sal, 2020 Available at: http://www.anp.gov.br/arquivos/estudos/aproveitamento-gn-presal.pdf, accessed on Nov. 21, 2021).

Schaefer et al. (SCHAEFER, B. et al. 2017. 2017. Technical-Economic Evaluation of Continuous CO2 Reinjection, Continuous Water Injection and Water Alternating Gas (WAG) Injection in Reservoirs Containing CO2. XXXVIII Iberian Latin-American Congress on Computational Methods in Engineering (CILAMCE 2017). Florianópolis, S C, Nov. 5-8, 10 2017) demonstrated by numerical simulation that WAG injection has a 25% to 30% increase in the final recovery of a reservoir, compared to the continuous injection of water or gas alone, in a reservoir with characteristics of the Brazilian pre-salt.

E, Lima et al. (LIMA et al. Journal of Petroleum Exploration and Production Technology (2020) 10:2947-2956. https://doi.org/10.1007/s13202-020-00968-4), also by numerical simulation demonstrated that the WAG injection (with CO2) has a greater increment in the final recovery of a reservoir with characteristics of the Brazilian pre-salt, than compared to continuous injection of water or CO2 alone.

According to the ANP, in the largest pre-salt reservoirs in operation (Lula, Sapinhoá, Búzios) the gas is injected into the oil zone. Gas is injected alternately with water, with the aim of controlling the gas advance front and improving displacement and scan efficiencies, thus, increasing the recovery. The more CO2 there is in the injected gas stream, the easier it is to develop miscibility between gas and oil, since under reservoir conditions CO2 tends to be an excellent solvent (ANP, Estudo sobre o aproveitamento do gas natural do Pré-sal, 2020 Available in: http://www.anp.gov.br/arquivos/estudos/aproveitamento-gn-presal. pdf, accessed on Nov. 21, 2021).

And, in the analyzes for the various Pre-Salt fields, PPSA, based on studies carried out by the operators, have observed that: when the reservoir does not present very significant depth differences, the reinjection of Water Alternating Gas (WAG), in a miscible process, provides the best results (ANP, Estudo sobre o aproveitamento do gas natural do Pré-sal, 2020 Available at: http://www.anp.gov.br/arquivos/estudos/aproveitamento-gn-presal. pdf, accessed on Nov. 21, 2021).

According to Lima, the general characteristics of Pre-salt reservoirs, high pressure, low temperature and the excellent quality of light oil are factors compatible with good miscibility between oil and gas (CO2), which are favorable for the application of the miscible WAG-CO2 method (LIMA, T M. Foam assisted water alternating gas—FAWAG: um potencial método de recuperação avançada para aplicação no pré-sal brasileiro. Course Completion Work—Petroleum Engineering-CEP/CT/UFRN 2021.1, April, 2021, NATAL, RN).

However, special attention must be given, as CO2 in contact with water forms carbonic acid causing corrosion in the materials made of carbon steel in which it is drained. And, if the boundary conditions in the reservoir have to be adequate for the injection of CO2, as well as the thermodynamic properties of the CO2-oil mixture, in which its efficiency depends on whether it will be miscible in the oil.

However, in the state of the art, in the WAG process, during periods of water injection in the reservoir, the CO2 generated in the SPU processes is discarded into the environment, thus increasing the greenhouse gases index.

Capture, Utilization and Storage of CO2.

According to the Intergovernmental Panel on Climate Change (IPCC), a United Nations board, global warming is primarily responsible for the anthropogenic emission of greenhouse gases (GHG) into the atmosphere.

The main consequences of global warming are the increase in the average temperature of the planet, the rise in sea level (due to the melting of the polar ice caps) and the increase in the frequency of extreme weather events, such as tropical storms, floods, heat waves, drought, blizzards, hurricanes, tornadoes and tsunamis, which have occurred in different regions of the planet. Thus, serious consequences are generated for populations and ecosystems, which may lead to the extinction of animal and plant species due to climate change.

One of the main human activities that emit large amounts of GHG that cause global warming and consequently climate change is the burning of fossil fuels (derived from petroleum, mineral coal and natural gas) to generate energy. And, among the GHGs, carbon dioxide ($CO_2$) is the one with the greatest contribution, as it accounts for the highest percentage of emissions into the atmosphere.

One of the measures to reduce the effect of GHGs is through the energy transition to a low-carbon economy, naturally conditioned to the use of cleaner alternative energy sources (wind, solar, hydraulic). But the speed of the energy transition can only be possible through consumers (more aware and more demanding) of products with a low carbon footprint and, of course, with strong investments and government plans worldwide, and with companies generating products with lower emissions of GHG.

Another measure for the reduction of GHGs is the Carbon, Capture, Utilization and Storage (CCUS). Generally, by this process the captured CO2 can be converted/mixed with other products/processes or be stored in geological formations, in large volumes and safely for long periods, such as depleted oil and gas reservoirs, saline aquifers and in the rocks salt caverns.

Specifically, in the petroleum industry, EOR-CO2 and EORWAG with CO2 (Azfali, S., Rezaei, N., Zendehboudi, S. A comprehensive review on Enhanced Oil Recovery by Water Alternating Gas (WAG) Injection, Fuel 227: 218-246, 2018) have been successfully used for decades and can be considered as important forms of CCUS (GRIGG, R. B., SVEC, R. K, Injectivity changes and CO2 Retention for EOR and Sequestration Projects, SPE/DOE Symposium on Improved Oil Recovery, USA, 2008; IEA, 2020. Energy Technology Perspectives 2020: Special Report on Carbon Capture Utilisation and Storage—CCUS in clean energy transitions. Paris, France), for mitigating GHG emissions. And, according to the International Energy Agency (IEA), CCUS is the main technology to enable the continued use of fossil fuels by adding value to the business and contributing to the longevity of the oil industry (IEA, 2020. Energy Technology Perspectives 2020: Special Report on Carbon Capture Utilisation and Storage—CCUS in clean energy transitions. Paris, France).

Geological Storage of CO2 in a Saline Rock Cavern.

The geological storage mechanisms of CO2 can be carried out in certain reservoirs/rocks in solid form (in rock reactive to CO2 forming a mineral precipitate), in the form of dissolution (in saline aquifers or in hydrocarbon reservoirs), adsorption (in the mineral wall and in pore throats), free-phase form (in structural or stratigraphic trapas, such as saline rock) (IPCC, 2005).

Due to its intrinsic characteristics such as porosity and negligible permeability and compressive strength similar to concrete (POIATE Jr E. Mecânica das Rochas e Mecânica Computacional para Projeto de Poços de Petróleo em Zonas de Sal. Tese de Doutorado, Pontificia Universidade Católica do Rio de Janeiro, PUC-Rio, Dezembro, 2012), make saline rock the ideal rock for the storage of various products, from compressed air (CROTOGINO F, MOHMEYER K U, SCHARF R. HUNTORF CAES: More than 20 Years of Successful Operation, Solution Mining Research Institute, Spring Meeting, Orlando, Florida, USA, 2001; SCHAINKER, R. B. Advanced Compressed Air Energy Storage (CAES) Demonstration Projects. EPRI Renewable Energy Council, 2011; VENKATARAMANI G, PARANKUSAM P, RAMALINGAM V, WANG J. A review on compressed air energy storage—A pathway for smartgrid and polygeneration. Renewable and Sustainable Energy Reviews, vol. 62, p 895-907, 2016.), crude oil (U.S. DEPARTMENT OF ENERGY, United States Department of Energy Carsbad Field Office. Available in: <http://www.wipp.energy.gov>. Access at: Apr. 27, 2006.), natural gas (EVANS D J, CHADWICK R A (EDS). Underground gas storage: Worldwide experiences and future development in the UK and Europe. The Geological Society, London, Special Publication, 313, 93-128. 2009; SYLVIE C G. Underground gas storage in the world. France, Rueil Malmaison, CEDIGAZ. 2016.), hydrogen (LORD, A S Overview of geologic storage of natural gas with emphasis on assessing the feasibility of storing hydrogen. SAND2009-5878. Sandia National Laboratories. 2009; LORD, A. S., KOBOS, P. H., BORNS, D. J. Geologic storage of hydrogen: Scaling up to meet city transportation demands. International Journal of Hydrogen Energy 39 (2014), p 11557-15582).

In terms of energy storage, the main function of using a cavern in salt rock (CRS) is to maintain a balance between demand and supply and meet daily or hourly demand peaks, thus mitigating fluctuations in the energy volumes consumed. And, under the strategic view, it also aims at long-term issues, such as international political instabilities that may occur, sharp variations in prices, in addition to allowing stocking the reserve for the future.

CRS also serves as a means of disposal for nuclear waste (MUNSON, D. E.; FOSSUM, A. F.; SENSENY, P. E. Approach to first principles model prediction of measured WIPP (Waste Isolation Pilot Plant) in-situ roam closure in salt. Tunneling and Underground Space Technology, 5, 135, 1990; U.S. DEPARTMENT OF ENERGY. United States Department of Energy Carsbad Field Office. Available in: <http://www.wipp.energy.gov>. Access at: Apr. 27, 2006) e de resíduos de perfuração (VEIL J A, SMITH K P, TOMASKO D, ELCOCK D, BLUNT D, WILLIAMS G P. 1998. Disposal of NORM-contaminated oil field wastes in Salt Caverns. United States: N.p., 1998. Web.doi:10.2172/808431). However, in this last embodiment it only happens at the end of the useful life of the CRS after 30 to 50 years operating as a storage medium. Thus, the return on investment with CRS is maximized.

Specifically, the geological storage of CO2 in CRS can make an excellent contribution in terms of the volume of CO2 trapped, but in terms of process safety over time, the mineral trapping mechanism is superior (IPCC, 2005. IPCC Special Report on Carbon Dioxide Capture and Storage. Prepared by Working Group Ili of the Intergovernmental Panel on Climate Change [METZ, B., O. DAVIDSON, H. C. de CONINCK, M. LOOS, and L. A. MEYER (eds.)]. Cambridge University Press, Cambridge, United Kingdom and New York, NY, USA, 2005, 442 p.).

Therefore, immediately constructing the CRS solely and exclusively for the storage (disposal) of CO2 would not be technically and economically interesting, as it would not be using its full potential, which allows several filling and emptying cycles with high injection rates and withdrawal in a single day, much superior when compared to a depleted or aquifer reservoir in terms of using CRS as means of production and storage.

Specifically, regarding the economic aspect, due to the fact that the CRS is a structure to be built for the storage of CO2, on the one hand, its CAPEX (Capital Expenditure) is high in relation to other storage solutions, such as, for example, in a saline aquifer or in a depleted reservoir (both widely available), thus, up to now, there is no CRS built specifically for this purpose, despite the existence of hundreds of CRS, used to storage different types of products. But, on the other hand, regarding the technical aspect, as it was designed specifically for this purpose, it is naturally a technology of greater safety and effectiveness over the time, in addition to enabling a high storage rate (Xie, L.-Z & Zhou, Hongwei & Xie, Heping. Research advance of CO2 storage in rock salt caverns. Yantu Lixue/Rock and Soil Mechanics. 5 30. 3324-3330, 2009) in which CO2 can remain in a liquid state.

In the state of the art (PEREIRA J C. Common Practices—Gas Cavem Site Characterization, Design, Construction, Maintenance, and Operation. Research Report RR2012-03. SMRI. 2012), the construction process of the CRS is carried out through the leaching process, also called dissolution mining, which consists of the solubilization or dissolution and removal of the chemical constituents of the saline rock by the action of water (fresh or saturated in NaCl). Initially, one or more access wells are drilled, and the rocks are drilled until they reach the region next to the top of the cavern that will be built. Then the drill string is removed for descending steel tube (casing), which will be cemented to provide a seal between the rock layers traversed by the drilling.

Two concentric columns comprising tubes are lowered near to the bottom of the well. One of them is used for water injection and the other for brine return. The innermost column, with a smaller diameter, is slightly longer (tens of meters) than the outer column in order to optimize the construction of the cavern.

The cavern construction begins with the circulation of fresh water or sea water with the purpose of dissolving the walls of the saline rock. The higher the temperature and flow rate of the injected water, the more efficient the salt dissolution will be. As the injected water becomes saturated, it is replaced with fresh water that is not yet fully saturated. This process of circulation of high flows of unsaturated water in the salt dissolves large amounts of it, giving rise to a large space filled with water (brine), which forms the cave.

After the construction of the CRS, it is necessary to replace the existing brine inside the CRS with the product to be stored in it, such as hydrocarbons, hydrogen, compressed air, rejects and others.

The process of replacing the brine with the product to be stored is called Dewatering and conventionally consists of flowing the brine from the CRS to a process plant to produce, for example, NaCl, PVC, and the like. But brine can also be discarded directly into the sea. This process takes place continuously in order for the CRS to be ready as quickly as possible (with the lowest possible amount of brine) to start the filling and emptying cycles of the stored product.

In the case of constructing an offshore CRS, it is necessary to use vessels equipped with a marine probe for a long period of time (up to more than a hundred days). Such probes are a high daily cost resource (hundreds and thousands of dollars) and sometimes unavailable due to competing with the construction of a new oil well.

Although there are studies and proposals for the use of saline caverns in deep waters, there is still no record of these caverns built by marine probes.

Therefore, the construction of the CRS in deep waters is inhibited by the high costs of vessels equipped with marine probes and the current dissolution construction methods require hundreds of days of operation. However, the development of new techniques that reduce the use of marine probes can make the construction of salt caverns economically viable even in deep waters.

In view of the difficulties present in the state of the art mentioned above, referring to the construction of caverns in saline rocks for the capture, utilization and storage of CO2 simultaneously and integrated to the WAG advanced recovery process, it remains the need to develop a technology capable of safely and efficiently capture, utilization and store co2 in an integrated manner with advanced oil recovery. The current state of the art mentioned above does not have the unique characteristics that will be presented in detail below.

OBJECT OF THE INVENTION

It is an object of the invention to provide a method of constructing salt caverns for capturing, using and storing CO2.

It is a second objective to provide a method of capturing, using and storing of CO2 in salt caverns simultaneously and integrated to the WAG advanced recovery process.

BRIEF DESCRIPTION OF THE INVENTION

The present invention refers to a method of constructing caverns in saline rock for the simultaneous capture, utilization and storage of CO2 and integrated to the WAG advanced recovery process, which substantially reduces the construction cost of said caverns and increases the CCUS.

The use of a cavern in saline rock (CRS) for the storage of CO2 is one of the possibilities within the concepts of Capture, Utilization and Storage of CO2, called in English Carbon Capture, Utilization, and Storage (CCUS) with the objective of reducing the emission of Greenhouse Gases (GHG) emitted into the atmosphere.

However, from a technical and economic point of view, it is not ideal, as the saline rock would not be subjected to filling and emptying cycles, which is one of the great advantages of CRS in relation to other storage media, given its intrinsic characteristics of negligible porosity and permeability.

However, combining the use of the cavern with oil recovery processes in the reservoir, in English, Enhanced Oi/Recovery (EOR), for example, in the Water Alternating Gas (WAG) process, means that it can storage the CO2 coming from the plant process of a Stationary Production Unit (SPU) or directly from a producing well (via submarine separation) in the periods when water (brine) is drained into the injector well, instead of the CO2 being released into the atmosphere, for posteriori to be the CO2 partially drained in the injector well and, even so, continue to storage the CO2 coming from the hydrocarbon production.

With that, periods of 2 to 24 months of brine emptying or CO2 filling in the CRS are carried out until the CRS is completely filled with CO2 in the liquid state and the well is definitively abandoned with cement plugs, as defined by the standards. In addition, all brine that is initially found in the cavern can be used in the EOR process by being drained to the injector well, that is, the brine is replaced by CO2 inside the CRS in a discontinuous way over the time, instead of being carried out immediately, continuously and discarded to the sea.

It is also possible to drain the water from the hydrocarbon separation processes to the CRS, especially in a well with a high amount of sediment and water content present in the hydrocarbon, in English, Basic Sediment and Water (BSW).

Thus, the method developed in the present invention makes it possible to carry out oil recovery (EOR) by means of water alternating gas WAG (brine-CO2) injection simultaneously (integrated) with the capture/storage (CCUS) of CO2 in the CRS, in which the CRS simultaneously acts as a control volume (lung/separator vessel) for the water alternating gas (brine-CO2) injection promoting hydrocarbon recovery (EOR) and CCUS.

Likewise, it is possible to build the CRS prior to the WAG process, or during the injection of CO2 into the reservoir, with most of the equipment used in the WAG process.

As a result, the new method enables interaction and integration between CRS, EOR-WAG and CCUS.

The method described and claimed in this document presents a condition that exceeds the state of the art by making the Dewatering process in the CRS occur discontinuously or in steps, by replacing the brine in the CRS by CO2, simultaneously with the WAG process. Likewise, most of the equipment used in the WAG process can be used previously in the construction of the CRS or during the injection of CO2 into the reservoir. With this, it enables enhanced oil recovery (EOR) simultaneously (integrated) with CO2 Capture, Utilization and Storage (CCUS), thus providing better results than the way described in the state of the art, where each technology is operated individually. Thus, the incremental oil margin produced using the CO2 injection together with the relative value of the CO2 emission reduction make certain oil fields economically viable and can increase the profitability in revitalizing certain fields by maximizing the recovery factor.

BRIEF DESCRIPTION OF DRAWINGS

The present invention will be described in more detail below, with reference to the attached figures which, in a schematic and not limiting of the inventive scope, represent examples of its realization. The drawings show.

Figure 1:
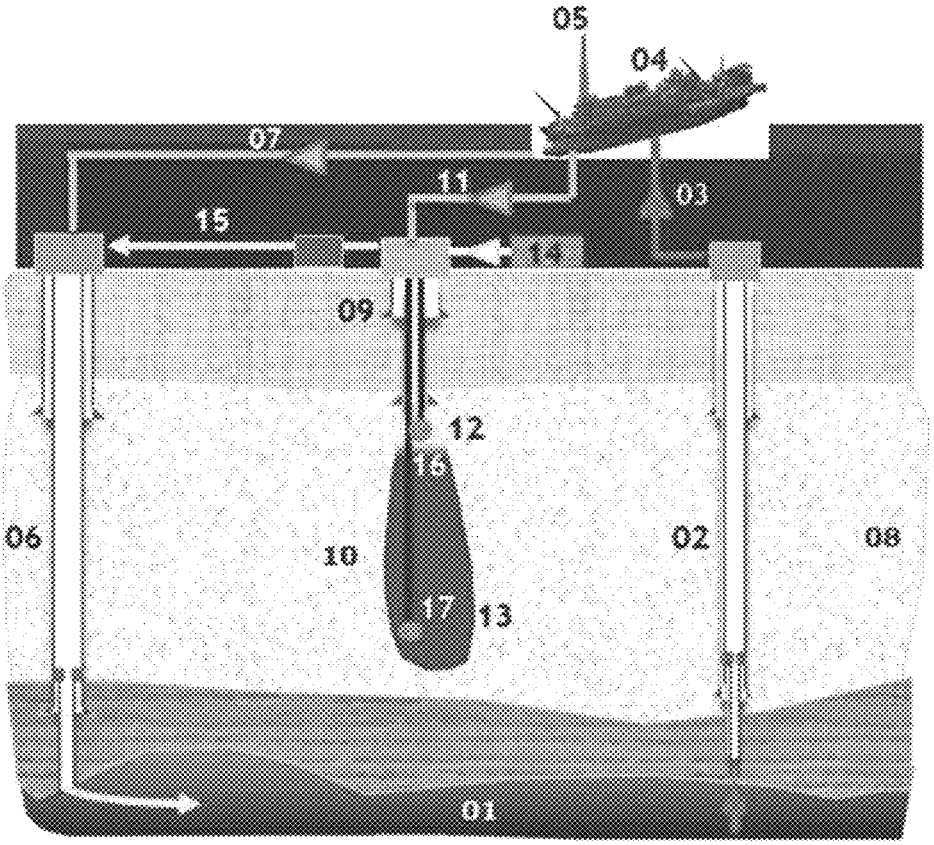
FIG. 1 schematically illustrates a cavern offshore in saline rock at the beginning of the process of replacing the brine in the cavern with CO2, in which the brine is injected into a well by the WAG process (water injection period) and the CO2 comes from a SPU.

The invention is described by means of the following reference numerals:

01—Oil reservoir;
02—Producing well;
03—Hydrocarbon flow from the well to the Stationary Production Unit (SPU);
04—SPU;
05—Flare;
06—Injector well;
07—Injection of water (brine) and/or processed gases into the injector well;
08—Evaporitic rock;
09—Cavern access well in saline rock (CRS);
10—CRS;
11—Injection of water (brine) or gases into the CRS from the separation processes at the SPU;
12—CO2 at the top of the CRS;
13—Water (brine) at the bottom of the CRS;
14—submarine raw water injection system;
15—Injection of water (brine) or gases into the injector well from the CRS;
16—Piping positioned next to the top of the CRS for CO2 inlet/outlet;
17—Piping positioned next to the bottom/base of the CRS for brine inlet/outlet;
18—Subsea oil-gas-water separation equipment
19—Oil drained to the SPU;
20—Gas and water drained to the CRS;
21—Abandonment of the CRS because it was full of CO2.

DETAILED DESCRIPTION OF THE INVENTION

The present invention relates to a method of constructing caverns in saline rocks for the capture, utilization and storage of CO2 simultaneously and integrated to the advanced recovery process of the WAG type, which substantially reduces the construction cost of said caverns and increases CCUS.

The hydrocarbon and other fluids produced in a reservoir (1) through a producing well (2) are drained (3) to a Stationary Production Unit (SPU) (4) to be processed through physical and/or chemical processes to separate the produced fluid into oil, gas and water (FIG. 1). The excess of gases produced, such as methane, ethane, butane, CO2, etc) is released/burned in the flare (05) to reduce the risk of explosions in the SPU, but it generates greenhouse gases. And, the water, after being treated and in accordance with current legislation, can be discarded.

Upon constructing an injector well (06) taking into account the type of oil recovery to be carried out, the gases and or even the water separated from the processed oil can be injected (07) into the injector well (06). However, the produced gases or water are not injected simultaneously into the injector well (06), either one is injected, or another is injected, or only one of them is injected. Therefore, at a certain time the gases are released into the flare (05), while the water is injected into the reservoir (01) through the injector well (06) or the water is discarded, while the gases are injected into the reservoir (01) through the injector well (06). As a result, even so, it generates greenhouse gases when gases are not being injected into the reservoir.

Below follows a detailed description of a preferred embodiment of the present invention, by way of example and in no way limiting. Nevertheless, it will be clear to a person skilled in the art, from the reading of this description, possible additional embodiments of the present invention further comprised by the essential and optional features below.

Figure 6:
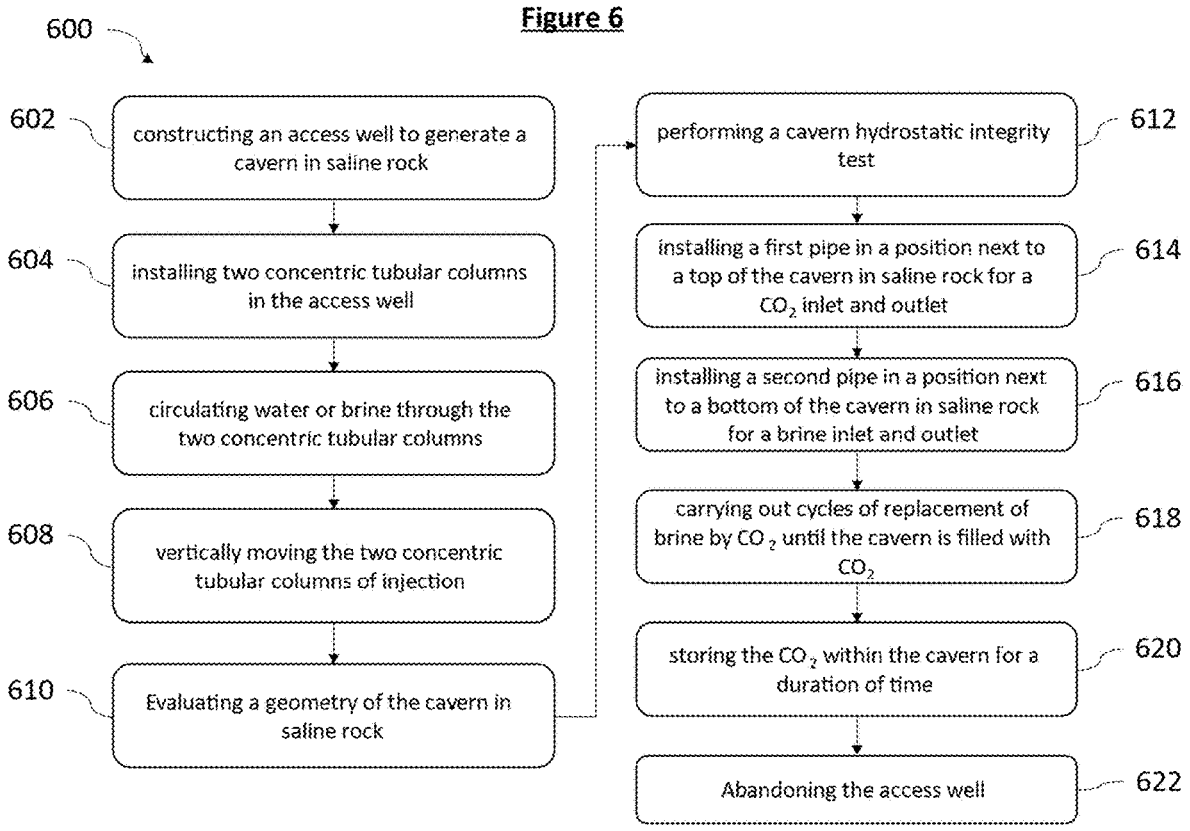
FIG. 6 is a flowchart of a method that can be used with aspects of this disclosure.

The method 600 for oil recovery integrated with the capture, utilization and storage of $CO_2$ through a saline rock cavern is characterized by having the following steps illustrated in FIG. 6. At 602, an access well is constructed to generate a cavern in saline rock. At 604, two concentric tubular columns are installed into the access well. At 606, water or brine is circulated through the two concentric tubular columns. At 608, the two concentric tubular columns of injection are moved vertically. At 610, a geometry of the cavern in saline rock is evaluated. At 612, a cavern hydrostatic integrity test is conducted. At 614, a first pipe is installed in a position next to a top of the cavern in saline rock for a $CO_2$ inlet and outlet. At 616, a second pipe is installed in a position next to a bottom of the cavern in saline rock for a brine inlet and outlet. At 618, cycles of replacement of brine by $CO_2$ are carried out until the cavern is filled with COz. At 620, $CO_2$ is stored within the cavern for a duration of time. At 622, the access well is abandoned.

In said method (FIG. 1), object of the present invention, with the presence of an evaporitic rock layer (08) close to the reservoir (01), an access well (09) for construction the saline rock in cavern (CRS) must be executed. After the last casing shoe is settled inside the salt layer, the salt layer is drilled to the predicted depth for the base of the CRS (not shown), after that, CO2 is injected into the access well, so that this gas protects the last casing shoe cemented in the access well against the dissolution of the water to be injected. Because CO2 is lighter, it will be at the top (12) of the CRS, while water will be at the bottom (13).

Thus, the construction of the CRS (10) begins by the leaching method from the injection into the access well (09) of water (with 0 at 300,000 ppm of NaCl) (11) coming from the reservoir (01), after passing by the separation processes at the SPU (04), instead of being discarded at the sea. The CRS can also be built by injecting seawater pumped directly from the SPU or by a submarine raw water injection system (SRWI) (14), with an energy source coming from the SPU.

The CRS can be generated with the same equipment (pumps, filters, separators, pipelines, etc.) used in the WAG-type oil recovery method, which originally inject water into the reservoir. With this, equipment costs for construction the CRS (around 40% of CAPEX) can be attenuated/reduced, due to the sharing of the same equipment with the WAG process.

And the CRS can be generated during the period in which CO2 is injected into the reservoir by the WAG-type oil recovery method. Therefore, both processes can occur simultaneously.

The water injection period for the construction of the CRS can be between 2 and 24 months, depending on the dimensions of the CRS, the flow rate and the temperature of the injection water, and the injection method can be direct or reverse circulation, such as the release of the CRS brine to the bottom of the sea.

During the period of the CRS construction in the injector well (06), the gases (07) from the SPU processes must be being injected.

Step 5 of the method establishes that the CRS geometry must be performed by sonar inside and/or outside the cavern. The result of this sonar assessment will enable decision making to move on to the final step 11 (abandonment of the well) or start the sequence of steps again from step 2 of the method.

At the end of the CRS construction, the injection of water (15) begins in the injector well (06), which can be the brine found in the CRS (13), thus promoting the beginning of the replacement process of the brine in the CRS. Specifically, this process will occur discontinuously or in steps, to be illustrated below. Meanwhile, gases (11), preferably CO2, from the SPU processes are injected into the CRS. At the end of the water injection period into the reservoir through the injector well (06), which can last from 2 to 24 months, depending on the characteristics of the reservoir, it is completed the first cycle of the WAG recovery method, which is integrated with CRS.

It is worth mentioning that inside the CRS there must be two pipes (16 and 17) (rigid or flexible), mentioned in step 8, one positioned next to the top of the CRS (16) for CO2 inlet/outlet, and another next to the bottom of the CRS (17), for brine inlet/outlet (FIG. 1).

The two pipes (16 and 17) must have a smaller diameter in relation to the last casing settled in the access well to the saline rock cavern, in the range of 10 to 50% smaller and must be operated alternately or simultaneously, replacing the brine in the CRS by CO2 discontinuously or in steps.

Therefore, the replacement of the brine in the CRS by CO2 must occur simultaneously with the WAG-type oil recovery method. And the WAG-type oil recovery method occurs concurrently with CO2 Capture, Utilization and Storage (CCUS) in the CRS.

And the brine emptying or CO2 filling periods in the CRS are from 2 to 24 months.

Figure 2:
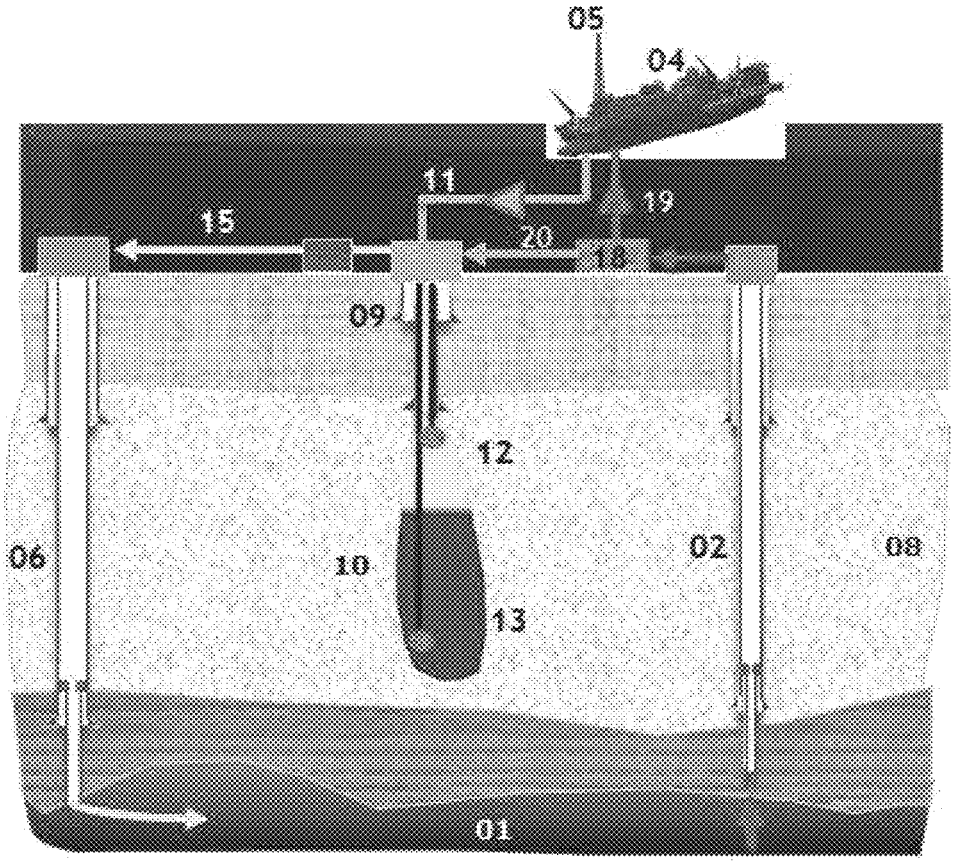
FIG. 2 schematically illustrates a variation of FIG. 1, in which the CO2 to be stored in the cave additionally comes from an underwater separation process.

Alternatively (FIG. 2), in the case of the presence of underwater separation equipment (oil-gas-water) (18), the oil is drained (19) to the SPU (4) and the gases, preferably CO2, and the water, are drained (20) to the CRS.

Figure 3:
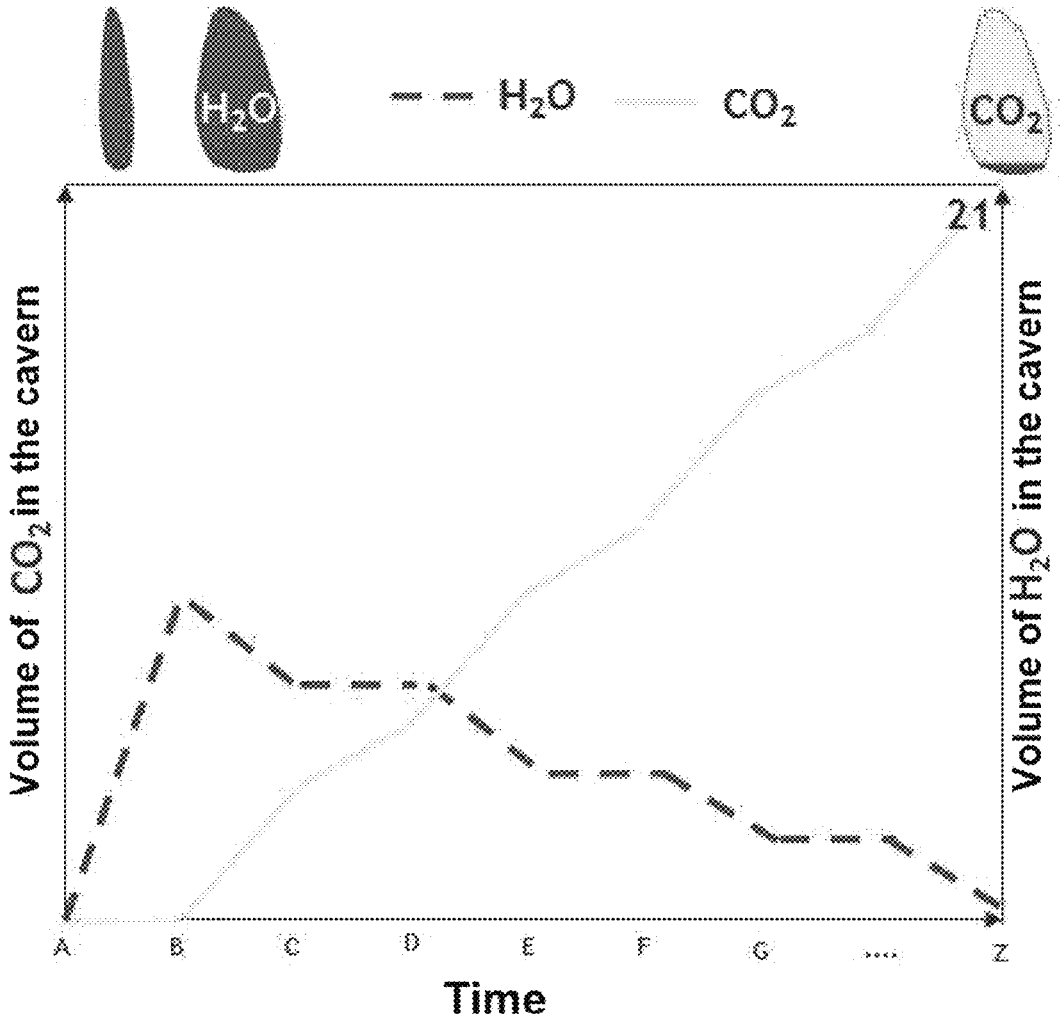
FIG. 3 schematically illustrates the variation of water and CO2 inside a saline rock cavern over the time, from the construction of the cavern, up to its abandonment, passing through several WAG cycles.

In order to present the construction processes of the CRS and the step-by-step replacement of the brine in the CRS by the CO2 of the present invention, FIG. 3 outlines the volumes of brine and CO2 present in the CRS over the time, which, depending on the dimensions of the CRS and reservoir characteristics for the WAG process, the time for each step can range from 2 to 24 months.

The time interval A-B represents the construction period of the CRS, so the volume of brine present in the CRS (dashed line) increases until reaching the final volume of the CRS, while the volume of CO2 in the CRS (solid line) remains almost zero (there is only the volume that protects the roof of the CRS against the dilution of the casing shoe base), because during this period CO2 is being injected into the reservoir.

Once the construction of the CRS is completed (time B), the injection of CO2 into the reservoir through the injector well can be interrupted and the injection of water (brine) from the CRS into the reservoir through the injector well can be started.

The time interval B-C represents the brine injection period in the injector well, so the volume of brine present in the CRS decreases (dashed line), while the volume of CO2 in the CRS increases (solid line). This happens because all the CO2 leaving the SPU process plant, which would conventionally be discarded in the environment, can now be drained to the CRS and, thus, facilitating the exit of the brine from the CRS (piston effect) to the injector well and yet promoting the Dewatering process in the CRS. In the case of a subsea CO2/hydrocarbon separator is present, the CO2 from a hydrocarbon producing well can be directly drained to the CRS without going through the SPU. It is worth mentioning that at time C the first WAG cycle in the reservoir is completed.

The time interval C-D represents the CO2 injection period in the injector well, so the volume of brine present in the CRS remains constant (dashed line), while the volume of CO2 in the CRS increases, but at a lower rate (lower slope of the straight), since part of the CO2 (generated in the SPU or coming from the well) goes to the injector well and part remains in the CRS (continuous line).

The advanced oil recovery process using the WAG method, integrated with CO2 storage through a CRS, occurs cyclically until time "Z" (FIG. 3). Therefore, time interval D-E is the repetition of time interval B-C and time interval E-F is the repetition of the time interval C-D. Such time intervals are repeated cyclically until the CRS is full of CO2 (21), time "Z", from then on, the CRS is abandoned through the execution of cement plugs for permanent abandonment of the access well to the CRS, thus completing the storage of CO2 in a CRS.

That is, while the volume of brine in the CRS decreases with time or cycles, the volume of CO2 grows, thus enabling the advanced recovery of oil by the EOR-WAG process (brine-CO2) simultaneously and integrated with the capture, utilization and storage of CO2 through the offshore CRS.

The time "Z" (FIG. 3) that it will take for the CRS to be filled with CO2 depends on the flow rates (brine and CO2) used in the WAG process, the number and time of each WAG cycle, as well as the dimensions of the CRS and its maximum allowable pressure. If production in the oil field continues in the same way, a new CRS is built to operate under the same conditions described above.

It is worth mentioning that in the case of an offshore CRS, given the intrinsic characteristics of the saline rock, the CO2 stored in the CRS can be in a liquid state, which allows a significant volume to be stored in relation to it in the gaseous state.

Figure 4:
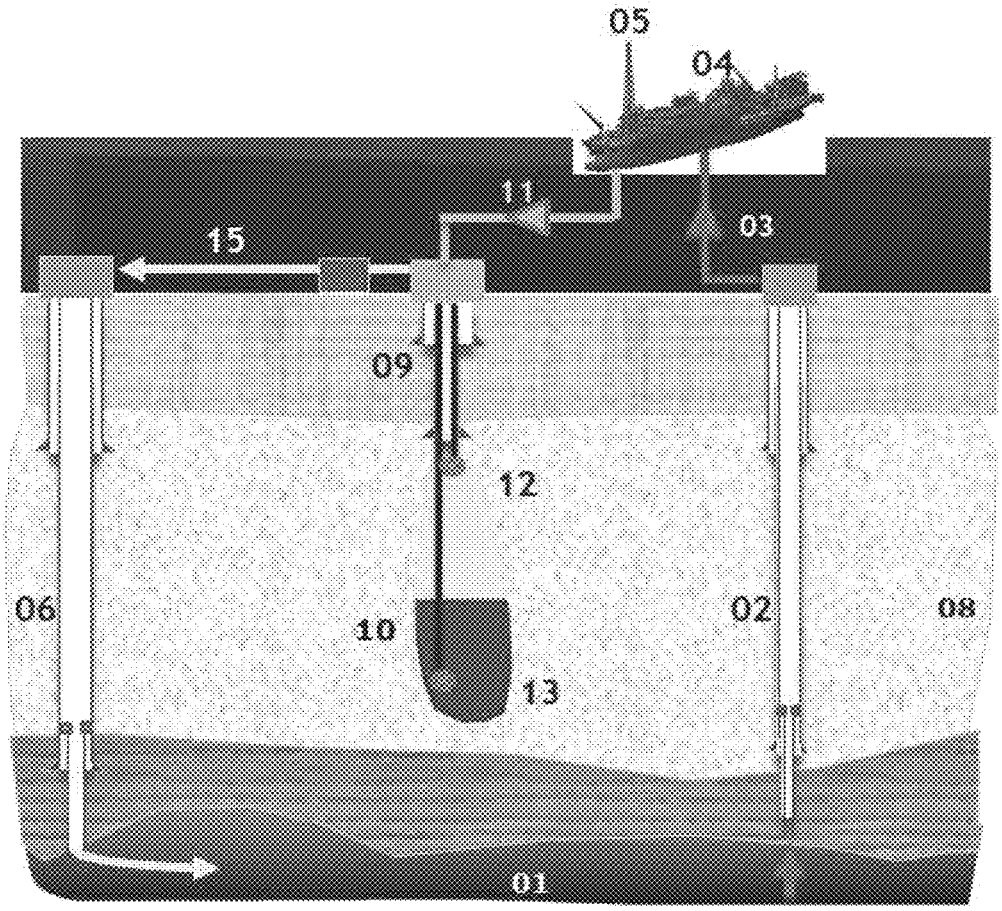
FIG. 4 schematically illustrates a variation of FIG. 1, in which the CO2 or H2O, coming from the processes of a stationary floating unit, can be drained into the saline rock cavern to then be used in the WAG process.

It is worth mentioning that it is also possible to drain the water (11) from the SPU (04) hydrocarbon separation processes to the CRS (10), as shown in FIG. 4, which shows the CRS (10) in a time when about half of the geometric volume of the CRS has CO2 (12) and the other half has brine (13).

Figure 5:
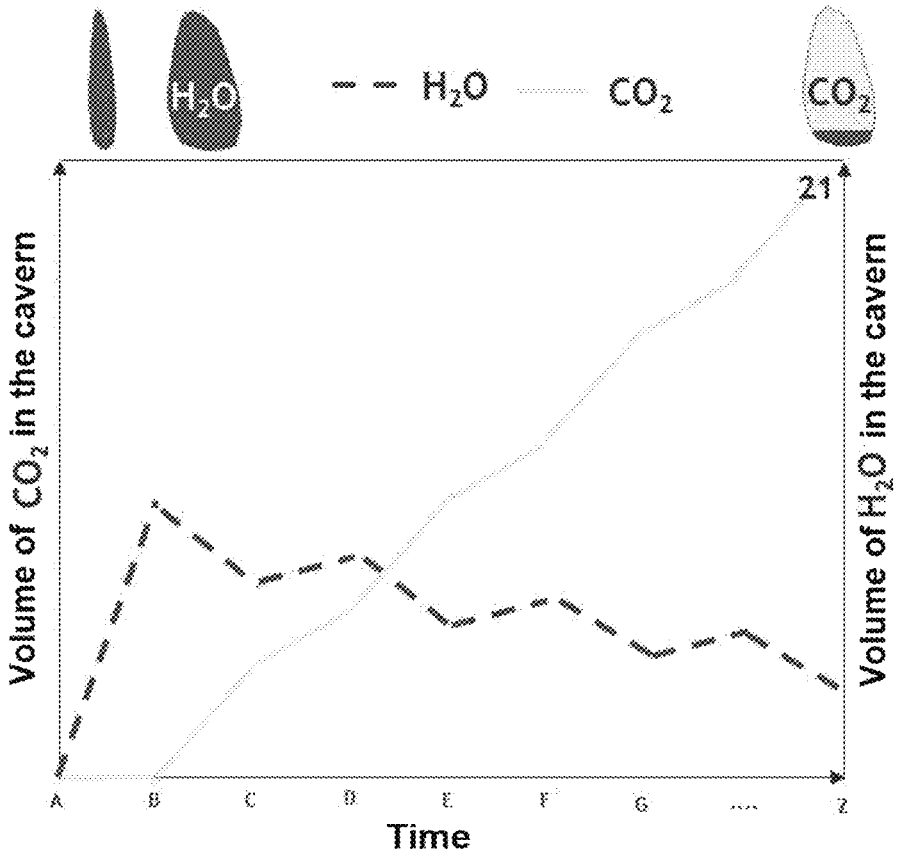
FIG. 5 schematically illustrates a variation of FIG. 3, in which H2O coming from the processes of a stationary floating unit can be drained into the saline rock cavern and, as this volume of water and CO2 vary within a rock cavern saline over the time, from the construction of the cavern, up to its abandonment, passing through several WAG cycles.

This condition is interesting in a hydrocarbon production condition (03) with a high amount of Basic Sediment and Water (BSW). Thus, instead of the brine volume in the CRS remaining constant during the CO2 injection period (sections C-D, E-F, dashed line, in FIG. 3) it has a slight increase, greater slope of the straight, (sections C-D, E-F, line dashed, in FIG. 5).

The description that has been made so far of the present method should be considered only as a possible embodiment, and any particular features should be understood as something that has been described to facilitate understanding. Thus, such features cannot be considered as limiting of the invention, which is limited only to the scope of the accompanying claims.

The invention claimed is:

1. An oil recovery method integrated with capture, utilization, and storage of $CO_2$ through a cavern in saline rock, the oil recovery method comprising:

constructing an access well to generate the cavern in saline rock;

installing two concentric tubular columns in the access well;

circulating water or brine through the two concentric tubular columns to dissolve salt to form the cavern in saline rock using equipment used in a Water Alternating Gas (WAG)-type oil recovery method, the equipment comprising:

pumps, filters;

separators; and pipelines;

vertically moving the two concentric tubular columns of injection;

evaluating a geometry of the cavern in saline rock:

performing a cavern hydrostatic integrity test;

installing a first pipe in a position next to a top of the cavern in saline rock for a $CO_2$ inlet and outlet;

installing a second pipe in a position next to a bottom of the cavern in saline rock for a brine inlet and outlet;

carrying out cycles of replacement of brine by $CO_2$ until the cavern is filled with $CO_2$, storing the $CO_2$ within the cavern for a duration of time; and abandoning the access well.

2. The method, according to claim 1, wherein the cavern in saline rock is formed during a period in which $CO_2$ is injected into the cavern during the WAG-type oil recovery method.

3. The method, according to claim 2, wherein a period of circulating water to form the cavern in saline rock is from 2 to 24 months.

4. The method, according to claim 1, wherein forming the cavern in saline rock occurs simultaneously with the WAG-type oil recovery method.

5. The method, according to claim 1, wherein circulating water to dissolve the salt is carried out by an autonomous subsea pumping system or by a Stationary Production Unit (SPU).

6. The method, according to claim 5, wherein the autonomous subsea pumping system or the SPU directs circulation or reverse circulation of water or brine inside the cavern in saline rock.

7. The method, according to claim 1, wherein evaluating the geometry of the cavern in saline rock is carried out by sonar inside and/or outside the cavern in saline rock.

8. The method, according to claim 1 further comprising, after evaluating the geometry of the cavern in saline rock, determining whether to abandon the access well or reinstall the two concentric tubular columns based on evaluating the geometry.

9. The method, according to claim 1, wherein the first pipe and the second pipe, at the top of the cavern in saline rock and at the bottom of the cavern in saline rock, respectively, are configured to direct fluids and gases entry and exit in the cavern in saline rock.

10. The method, according to claim 9, wherein the first pipe and the second pipe comprise rigid or flexible tubes, wherein one of the first pipe or the second pipe is positioned between 1 and 10 m from the top of the cavern in saline rock, for entry and exit of $CO_2$, and the other of the first pipe or the second pipe is between 1 and 10 m from the bottom of the saline rock cavern, for brine entry and exit.

11. The method according to claim 10, wherein the first pipe and the second pipe each have a smaller diameter in relation to the access well in a range of 10% to 50% smaller.

12. The method, according to claim 11, wherein the first pipe and the second pipe are operated alternately or simultaneously substituting brine in the saline rock cavern for $CO_2$ discontinuously or in steps.

13. The method, according to claim 12, wherein the substituting the brine in the saline rock cavern by $CO_2$ occurs simultaneously with the WAG-type oil recovery method.

14. The method, according to claim 1, wherein the WAG-type oil recovery method occurs simultaneously with a capture, utilization, and storage of $CO_2$ in the cavern in saline rock.

15. The method, according to claim 1, wherein substituting the brine or $CO_2$ filling periods in the cavern in saline rock range from 2 to 24 months.

16. The method, according to claim 1, wherein the well is abandoned with cement plugs after carrying out cycles of replacement of brine by $CO_2$ until the saline rock cavern is filled with $CO_2$.

17. The method, according to claim 1, wherein the brine and $CO_2$ are circulated from a stationary production unit.

* * * * *